United States Patent [19]

Anastasi et al.

[11] 4,220,807

[45] Sep. 2, 1980

[54] TRANSMISSION CABLE

[75] Inventors: James Anastasi, Willimantic; Thomas S. Redmerski, Mansfield Center, both of Conn.

[73] Assignee: Akzona Incorporated, Asheville, N.C.

[21] Appl. No.: 914,264

[22] Filed: Jun. 12, 1978

[51] Int. Cl.[2] ..... H01B 7/08

[52] U.S. Cl. ..... 174/36; 174/110 F; 174/117 F

[58] Field of Search ..... 174/27, 32, 36, 110, 174/117 F

[56] References Cited

U.S. PATENT DOCUMENTS

| | | | |
|---|---|---|---|
| 2,814,666 | 11/1957 | Maddox | 174/27 X |
| 3,040,278 | 6/1962 | Griemsmann | 174/110 F |
| 3,315,025 | 4/1967 | Tomlinson | 174/107 |
| 3,516,859 | 6/1970 | Geland | 174/110 F |
| 3,634,782 | 1/1972 | Marshall | 174/36 X |
| 3,735,022 | 5/1973 | Estep | 174/117 F |
| 3,867,565 | 2/1975 | Prentice | 174/36 X |

FOREIGN PATENT DOCUMENTS

| | | | |
|---|---|---|---|
| 824288 | 9/1969 | Canada | 174/110 F |
| 352041 | 7/1931 | United Kingdom | 174/117 F |

OTHER PUBLICATIONS

Kolias, J. T., Trilead Cable, IBM Technical Disclosure Bulletin, vol. 12, #5 Oct. 1969 p. 659.

*Primary Examiner*—Richard R. Kucia

*Attorney, Agent, or Firm*—Francis W. Young; David M. Carter

[57] ABSTRACT

There is provided an improved electrical signal transmission cable having at least one signal-carrying center conductor and respective flanking ground conductors. The center conductor is surrounded by a thin layer of polymeric foam insulation. The foam insulated center conductor and the ground conductors are embedded in a solid polymeric insulation. This construction provides for an increased signal propagation velocity as well as for the maintenance of center-to-center distances for the conductors both during the manufacture of and normal use of the cable.

2 Claims, 2 Drawing Figures

TRANSMISSION CABLE

BACKGROUND OF THE INVENTION

This invention relates to electrical transmission cables. More particularly, it relates to an electrical transmission cable having increased signal propagation speeds.

Data transmission from one circuit to another requires the use of an electrical cable constructed to provide adequate signal propagation velocities as well as to provide a characteristic impedance which approximately matches the circuit which the cable is attached to. One type of cable which has been found to be adequate in these respect for computer uses is the so-called coaxial cable. However, many end users do not have the equipment to terminate coaxial cable, therefore its use has proved rather limited.

A type of cable which has satisfied many of these needs is the so-called tri-lead cable. An example of the tri-lead cable is shown in cross section in FIG. 1. Tri-lead cable 1 includes a center conductor 2 and a pair of ground conductors 3 and 4. The center conductor 2 acts as the signal transmission conductor. The ground conductors 3 and 4 act to shield the signal conductor from extraneous electrical fields. These three conductors are embedded in an insulation block 5, which in most embodiments is Fluorinated Ethylene Propylene (FEP). FEP has a dielectric constant of aproximately 2.15. Furthermore, this FEP insulation block is rigid enough to maintain proper center-to-center spatial relationship among the conductors in order to provide for a particular uniform characteristic impedance for each cable so that it will match the characteristic impedance of the electrical circuits which this cable will interconnect.

With the advent of electronic circuits, such as in computers, having greatly increased switching speeds, it has been found that this prior art type of tri-lead cable has become a bottleneck for the overall computer response time. It has been shown that a sample of above-described prior art tri-lead cable, having a characteristic impedance such as 93 ohms, has a signal velocity of propagation of 1.39 nanoseconds per foot, which is approximately 71.9 percent of the velocity of light. It is desirable to provide a cable having substantially all of the effectiveness of the old tri-lead cable but having increased velocity of propagation speeds without substantially altering the characteristic impedance of the cable.

OBJECTS OF THE INVENTION

It is therefore one object of the invention to provide an improved electrical signal transmission cable.

It is another object of the invention to provide an electrical transmission cable having increased velocity of signal propagation.

It is still another object of the invention to provide an improved electrical transmission cable having improved velocity of propagation for signals yet maintaining the proper characteristic impedance for its end use.

SUMMARY OF THE INVENTION

In accordance with one form of this invention there is provided an improved electrical signal transmission cable having at least one signal conductor. The signal conductor is substantially surrounded by and in contact with a polymeric foam insulation. At least one ground conductor is located a predetermined distance from the signal conductor. The ground conductor acts as a shield for the signal conductor. The ground conductor and the insulated signal conductor are embedded in an electrical insulation having a density greater than the foam insulation. Thus the signal propagation velocity of the cable is increased relative to non-foamed insulated cable and the predetermined distance between the signal conductor and the ground conductor is maintained substantially constant both during the manufacture and the normal use of the cable.

BRIEF DESCRIPTION OF THE DRAWINGS

The subject matter which is regarded as the invention is set forth in the appended claims. The invention itself or together with further objects and advantages thereof may be better understood by reference to the following description taken in conjunction with accompanying drawings in which:

DESCRIPTON OF THE PREFERRED EMBODIMENT

Figure 2:
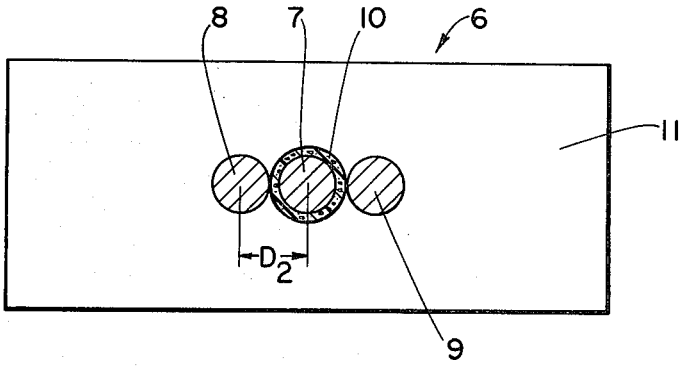
FIG. 2 is a cross section of the cable showing some of the aspects of the invention.

Referring now more particularly to FIG. 2, there is provided electrical transmission cable 6 having a center signal carrying conductor 7 and a pair of flanking ground conductors 8 and 9. The electrical signal conductor is surrounded by a foam insulation 10, which is a polymeric material.

In the exemplification embodiment, this foam insulation is a polypropylene foam. It has been found that in certain instances polypropylene is particularly advantageous because of its ability to provide a foam having a great number of very small gas pockets, which will be discussed later.

The ground conductors 8 and 9 are adjacent to the foam about the signal conductor and provide an electrical shield for the signal conductor. All of these three conductors are embedded in another polymeric insulation material 11 having a density much greater than the density of the foam material 10. In this embodiment the high density insulation material is polyethylene. It is preferred that the polyethylene be cross-linked either by chemical or irradiation means for toughness. Furthermore, it is preferred that a flame retardant such as antimony trioxide be added to the polyethylene so that the cable will be self-extinguishing in case of a fire. This solid polyethylene insulation block 11 provides proper space relation among the conductors and the cable so that the characteristic impedance of the cable may be maintained. This spacing must be maintained both during the manufacture of the cable and during the normal use of the cable. Thus a tough polyethylene insulation block 11 has been found adequate for these purposes. As stated previously, it is important that the characteristic impedance of the cable of FIG. 2 be maintained substantially similar to the characteristic impedance of the cable of the old tri-lead cable shown in FIG. 1 for matching the impedance of the electrical components which it interconnects.

Characteristic impedance for a tri-lead cable is given by the formula:

$$Z_o = 276/\sqrt{K_e} \times \mathrm{Log}_{10}(8D/\pi d)$$

where $K_e$ is equal to the composite dielectric constant of the foam insulation and any solid insulation between the signal conductor to the ground conductor, D is equal to the center-to-center distance between the center conductor and an adjacent ground conductor, and d is equal to the diameter of the signal conductor.

Figure 1:
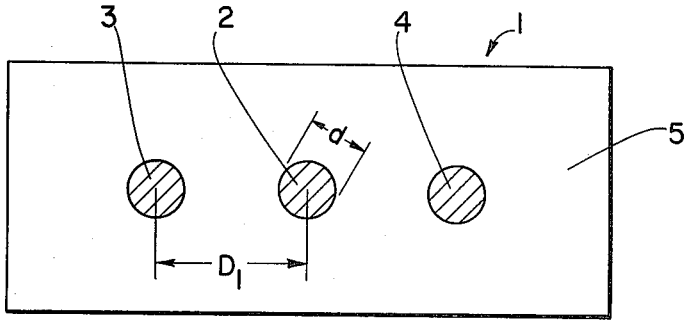
PRIOR ART FIG. 1
FIG. 1 is a cross section of a prior art tri-lead transmission cable.

The cable shown in FIG. 2 utilizes a foam insulation 10 which has a dielectric constant of approximately 1.66 which is substantially lower than the dielectric constant of the solid material between conductors 2 and 3 shown in FIG. 1. In order to maintain the characteristic impedance of the cable of FIG. 2 substantially the same as the tri-lead cable shown in FIG. 1, it will be necessary to either increase the conductor diameter d of the center conductor or decrease the center-to-center distance D between the adjacent conductors. It has been found that to increase the diameter of the conductor results in too large a configuration, therefore, the center-to-center distance is shown as $D_2$. $D_2$ is therefore less than $D_1$. As stated previously, polypropylene is used as the foam material 10. Polypropylene is well suited because one is able to extrude polypropylene in a very thin foamed layer about a conductor. This thin foamed polypropylene has a great number of tiny gas pockets per unit volume as opposed to some other materials. A thin foamed insulation 10 is necessary so that the shield conductors 8 and 9 may be placed sufficiently close to the signal conductor 7 in order to maintain a specified characteristic impedance of the cable as explained above. In one embodiment the thickness of the foam insulation 10 was approximately 21 mils, the diameter of the wire d=7.1 mils and the center-to-center distance $D_2$ between adjacent wires was 16 mils. The foam density was 0.499 grams/cm with approximately 54% of the volume of the foam insulation 10 containing gas bubbles. The polyethylene block insulation was 28×68 mils. A Time Domain Reflectometer (TDR) was utilized for electrical measurements. This yielded a characteristic impedance of 82 ohms. The velocity of signal propagation was measured at 1.24 nanoseconds per foot or approximately 80.4 percent of the velocity of light. This represents nearly a 10% increase in propagation speed over corresponding prior art FEP Tri-lead cable which is very significant especially in computer and other high speed electronic applications. The cost effectiveness of the old Tri-lead is substantially maintained, and more importantly the spacing among conductors is maintained constant both during the manufacture and normal use of the cable even though a sufficient quantity of foam is used to lower the dielectric constant for such a significant increase in propagation speeds.

The cable set forth in FIG. 2 has been manufactured utilizing the following process, Copper conductor 7, which is the signal coductor, was run through an extruder containing polypropylene foam insulation utilizing known extrusion techniques. Polypropylene was mixed with a powdered blowing agent azodicarbonamide and then extruded on the signal conductor in the extrusion head. After the foam polypropylene had cured the foam insulated conductor was placed in parallel to and coplanar with ground conductors 8 and 9 and polyethylene mixed with the flame retardant was then extruded in a substantial rectangular configuration, again using known techniques. The entire cable was then cross-linked in a known manner in order to provide toughness to the outer jacket. From the foregoing description of the preferred embodiment of the invention, it will be apparent that many modifications may be made therein. It will be understood therefore that this embodiment of the invention is intended as an exemplification of the invention only and that the invention is not limited thereto. It is to be understood, therefore, that it is intended in the appended claims to cover all such modifications as fall within the true spirit and scope of the invention.

What is claimed is:

1. An electrical signal transmission cable comprising:

a signal conductor; said signal conductor substantially surrounded by and in contact with a polymeric foam insulation; said polymeric foam insulation being constructed substantially of polypropylene wherein the foam bubble density is approximately 0.499 grams per cubic cm.;

at least one ground conductor located a predetermined distance from said signal conductor; said ground conductor acting as a shield for said signal conductor;

said at least one ground conductor and said at least one foam insulated signal conductor being embedded in an electrical insulation having a density greater than said foam insulation whereby the signal propagation velocity of said cable is substantially increased over a non-foam insulated cable and the predetermined distance between said at least one signal conductor and said at least one ground conductor is maintained substantially constant during normal use for maintaining a predetermined characteristic impedance for said cable.

2. An electrical signal transmission cable comprising:

a signal conductor; said signal conductor being insulated by a polymeric foam insulation; said polymeric foam insulation being substantially constructed of polypropylene;

at least two ground conductors located adjacent to and in contact with said polymeric foam insulation; said foam insulated signal conductor and ground conductors being embedded in a high density insulation whereby said cable provides a signal transmission speed approximating 80 percent of the speed of light and said conductors are maintained at a proper space relationship relative to one another to provide a predetermined charcteristic impedance of said cable.

* * * * *